US005332321A

United States Patent [19]

Beauchamp et al.

[11] Patent Number: 5,332,321

[45] Date of Patent: Jul. 26, 1994

[54] TWO LINE CONTACT BUSHING MOUNTING OF A PLOTTER CARRIAGE WITH PRE-LOAD

[75] Inventors: Robert W. Beauchamp, Carlsbad, Calif.; Michael A. Nguyen, Singapore, Singapore

[73] Assignee: Hewlett-Packard Corporation, Palo Alto, Calif.

[21] Appl. No.: 57,240

[22] Filed: Apr. 30, 1993

Related U.S. Application Data

[63] Continuation-in-part of Ser. No. 965,480, Oct. 23, 1992.

[51] Int. Cl.[5] ..... B41J 11/22

[52] U.S. Cl. ..... 400/354; 400/53

[58] Field of Search ..... 400/53, 161, 161.1, 400/283, 352, 353, 354, 354.1, 354.2; 384/37, 38, 42

[56] References Cited

U.S. PATENT DOCUMENTS

| | | | |
|---|---|---|---|
| 4,418,371 | 11/1983 | Menden | 400/354 |
| 4,514,101 | 4/1985 | Smith | 400/354 |
| 5,033,869 | 7/1991 | Kingston et al. | 384/38 |

*Primary Examiner*—Edgar S. Burr
*Assistant Examiner*—Ren Yan

[57] ABSTRACT

A molded plastic printer carriage mountable in the printer on a pair of slider rods uses a pair of spaced front bushings and single rear bushing positioned on a line intermediate the two front bushings. The rear bushing is eccentricly spring biased in a direction away from the front bushings and each bushing has two line contacts with the slider rod on which it is mounted, the first of the line contacts being at the top of the bushing and the second being on the side of the bushing substantially facing the opposite slider rod. The eccentric spring biasing and the two line contact configuration of the bushings prevents rotation of the carriage around the slider rods during rapid movement thereof during printing.

9 Claims, 4 Drawing Sheets

TWO LINE CONTACT BUSHING MOUNTING OF A PLOTTER CARRIAGE WITH PRE-LOAD

CROSS REFERENCE TO RELATED APPLICATIONS, IF ANY,

This application is a Continuation In Part of United States patent application titled PRINTER CARRIAGE BUSHING filed Oct. 23, 1992 by Michael Nguyen under Ser. No. 07/965,480 and also relates to the same general subject matter as is disclosed in the application by Abdol Reza Movaghar, et al, titled SPLIT BUSHING MOUNTING OF A PRINTER CARRIAGE WITH PRE-LOAD, Ser. No. 08/056,335 filed Apr. 30, 1993, each assigned to the assignee of the present invention.

BACKGROUND OF THE INVENTION AND PRIOR ART

The present invention relates to a carriage pre-load support and bushing system for a large scale computer driven plotter carriage which slides back and forth transversely of the path of paper travel through the plotter on a pair of smooth support rods which are ordinarily cylindrical.

Carriage bushing systems require high tolerance and low friction and have inherently conflicting design requirements since high tolerance bushing systems require dimensionally stable materials which usually have high coefficients of friction. Conversely, a bushing system which is constructed primarily of lubricous material for reduced friction tends to be dimensionally unstable. The problem is compounded with increasing size of the printer or plotter. Low friction bushings can be manufactured to the required tolerances by secondary machining operations with repeated inspections and rejection of bushings that are not manufactured to the correct tolerance. Clearly, such operations materially increase the per part finished cost.

A carriage support system which can be manufactured to and retain close tolerances is therefore required for large scale plotter carriages such as for drafting plotters which must move without impediment at a high rate of speed with frequent reversals in the direction of movement along the slider rods.

SUMMARY OF THE INVENTION

The present invention provides a printer carriage comprising a frame having a plurality of print cartridge receptacles and a support system thereon, said support system comprising a front slider rod channel, a pair of bushings in said front slider rod channel for supporting said carriage for sliding movement on a front carriage slider rod, a rear slider rod bushing mounted on said carriage for supporting said carriage for sliding movement on a rear carriage slider rod, means for resiliently biasing said rear bushing in a direction away from said front bushings, said front and rear bushings each having first and second arcuately spaced contact surfaces for contacting the respective slider rods along two spaced parallel lines, said first contact surfaces on each bushing being proximate a top center portion thereof and said second contact surfaces of said front bushings substantially facing said second contact surface of said rear bushing.

DESCRIPTION OF THE PREFERRED EMBODIMENT

Figure 1:
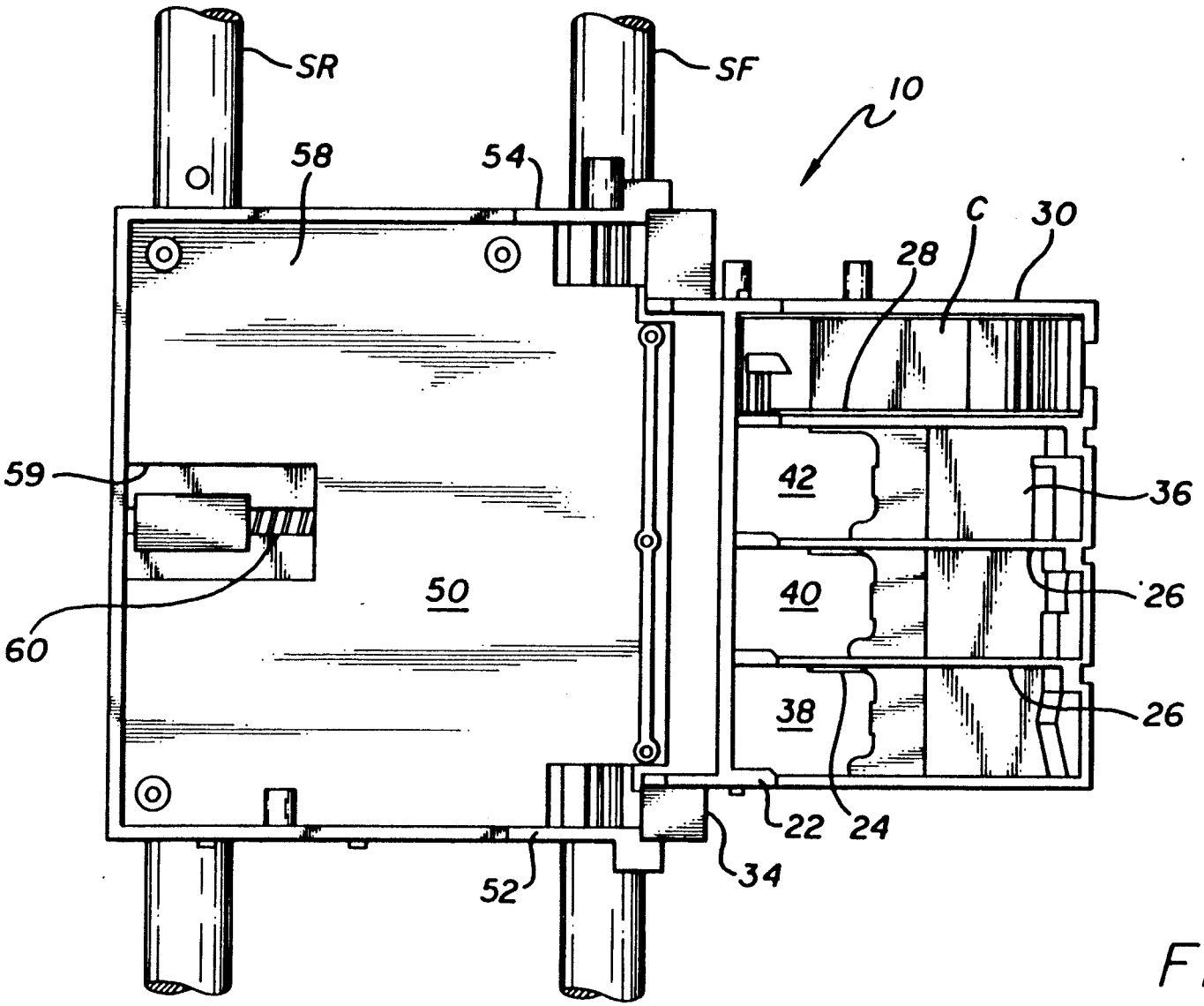
FIG. 1 is a plan view of a plotter carriage incorporating the teachings of the present invention.

FIG. 1 shows a plan view of a carriage 10 useful in a large scale computer driven plotter, particularly in a color ink jet drafting plotter, which uses a plurality of ink cartridges. Ordinarily, four ink cartridges C (one of which is shown) are provided comprising the color black and three primary colors. The front portion 20 (FIG. 2) of the carriage comprises a molded plastic member comprised of five vertically extending generally L-shaped parallel spaced plates 22, 24, 26, 28, 30 which define four printer ink cartridge receptacles therebetween. The front portion 20 of the carriage also has an integrally formed vertical mounting wall 34 and an integrally formed bottom 36 provided with four apertures 38, 40, 42 (three are seen in FIG. 1) which receive the nozzle portions N (FIG. 2) of the print cartridges through which ink is jetted downwardly onto the paper or other medium on which printing is to take place.

Figure 5:
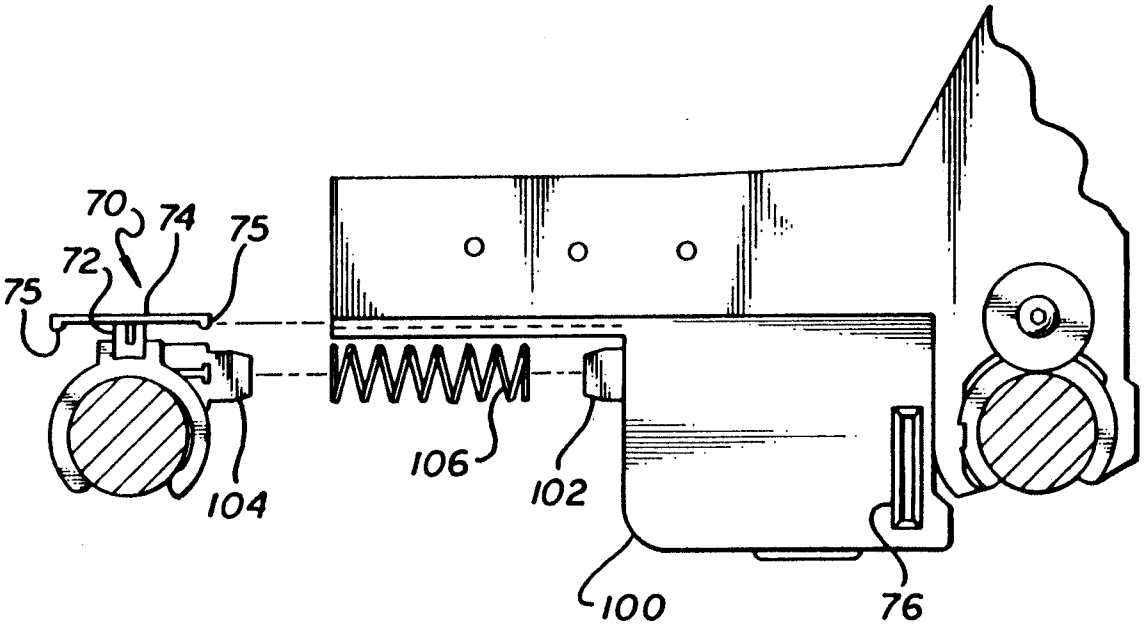
FIG. 5 is a partial side elevation of the carriage to an enlarged scale and exploded to show the carriage, a bushing biasing spring and the rear bushing.
Figure 6:
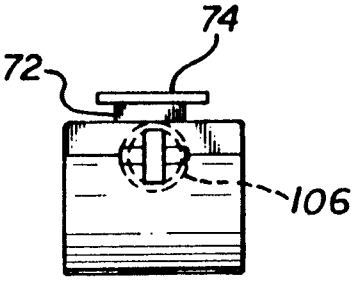
FIG. 6 is an enlarged view of the front of the rear bushing.

The carriage 10 also has a rear portion 50 comprising a molded tray having a pair of upstanding walls 52, 54 at each side which are affixed by screws 56 to the vertical wall 34 of the front portion 20 of the carriage. The bottom 58 of the tray has a recess 59 in its upper surface with an elongated slot 60 therein for receiving the connecting strut 72 (FIGS. 5 and 6) of a top support wing 74 integrally formed on a moveable rear bushing 70. Wing 74 has a pair of rounded contact lips 75 on its undersurface for a purpose to be described. The carriage 10 is supported on parallel front and rear slider rods SF and SR in the plotter and is pulled back and forth by a belt (not shown) which is connected to the carriage 10 at a slot 76 between the front and rear slider rods. Carriage 10 moves in a direction transverse to the direction of movement of paper through the plotter.

A pair of plastic front bushings 80, 82 are mounted at opposite ends of a front slider rod channel 84 on the underside of the rear portion 50 of the carriage.

Figure 3A:
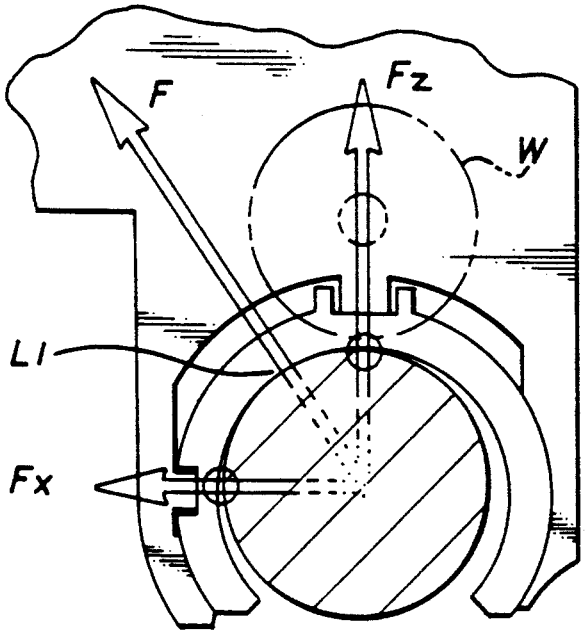
FIG. 3A PRIOR ART
FIGS. 3A and 3B respectively show enlarged side elevation views of a prior art bushing and a bushing constructed according to the teachings of the present invention.
Figure 3B:
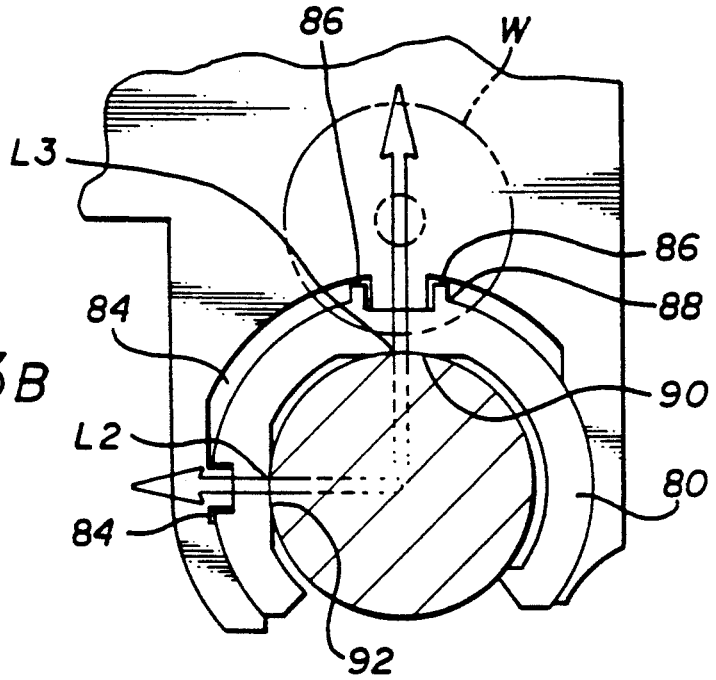
Figure 4:
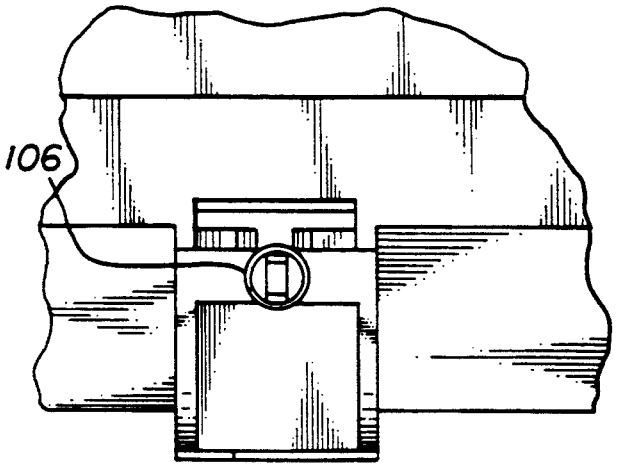
FIG. 4 is a partial rear elevation view of the carriage shown to an enlarged scale with the rear bushing removed therefrom.
Figure 7:
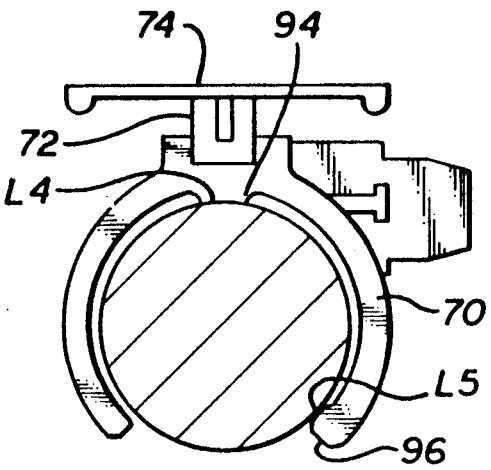
FIG. 7 is an enlarged side elevation of the rear bushing.

The front bushings 80, 82 are best described with reference to FIGS. 3A and 3B. Each front bushing comprises a plastic C-shaped open section provided with axially extending spaced keys 86 or slots which abut mating keys 88 or slots in the plastic carriage channel 84 to prevent rotational movement of the bushings with respect to the carriage. Axial movement of the bushings 80, 82 is prevented by abutment of the inner ends of the bushings with integrally molded carriage walls which transversely extend across part of the slider rod channel and washers W (shown in phantom) which are screw connected to the carriage to partially cover the outer ends of the bushings 80, 82.

In the prior art bushings, each bushing has a generally cylindrical inner bearing surface which makes a single line contact L1 with the slider rod. FIGS. 3A and 3B are drawn to an exaggerated scale to show that, despite close machining and tolerance control, the center of curvature of the bushing does not always precisely correspond with the center of curvature of the slider rod. Thus, the prior art bushing contacts the slider rod only at a single line of contact L1 as seen in FIG. 3A. The exact compass position of the single line of contact L1 varies with the ratio of the horizontal and vertical components $F_x$, $F_z$ of the contact force F which continuously changes location during printing due to rocking of the carriage on the slider rods.

Each front bushing constructed according to the teachings of the present invention is an open C-shape section having a pair of axially extending internal lands 90, 92 comprising circumferentially spaced bearing surfaces. A first (90) of the lands is located in each bushing at the top or 0° compass position thereof. As viewed in FIG. 2, the second land (92) on the front bushings is located at substantially the 270° position. Each land 90, 92 extends through a small arc so that the bushing contacts the exterior cylindrical surface of the associated slider rod SF, SR along two lines of contact L2, L3. It will be evident that the two line contacts L2, L3 on the front bushings are approximately 90° apart such that the horizontal and vertical components $F_x$ and $F_z$ of the contact force F remain constantly directed in the horizontal and vertical directions respectively, as compared with the prior art single line contact support of a carriage in bushings which contact the slider rods at a varying single line position L1 depending upon the ratio of the horizontal and vertical force components. Each land 90, 92 may also have one or more axially extending lubrication grooves (not shown) therein.

The concave portion of the rear bushing 70 is constructed similar to the front bushings 80 described above in that it has two spaced lands 94, 96 for contacting the rear slider rod SR along two spaced lines of contact L4, L5. The lower land 96 of the rear bushing provides a line contact L5 located at the lower tip end of the rear bushing which faces the front bushings—i.e., at about the 100° position so that the second land 96 of the rear bushing substantially faces the second land 92 of the front bushings. The lower land 96 is below a horizontal line extending between the centerlines of the front and rear bushings. Secondly, the rear bushing also differs from the front bushings in that it is not rigidly affixed to the carriage frame but instead has a supporting strut 72 and wing 74 integrally molded therewith so that the bushing can be mounted on the rear carriage portion for movement along the line of the horizontally extending slot 60. The slot is centered on a line normal to the two slider rods and preferably intermediate the two front bushings (FIG. 1). The rear carriage portion 50 also has a downwardly depending wall 100 having a spring seat 102 thereon which is opposed to an integrally molded spring seat 104 on the rear bushing 70 so that opposite ends of a compression spring 106 can be seated on the seats 102, 104 to urge the rear bushing 70 in a horizontal direction away from the front bushings toward the rear slider rod SR.

Figure 2:
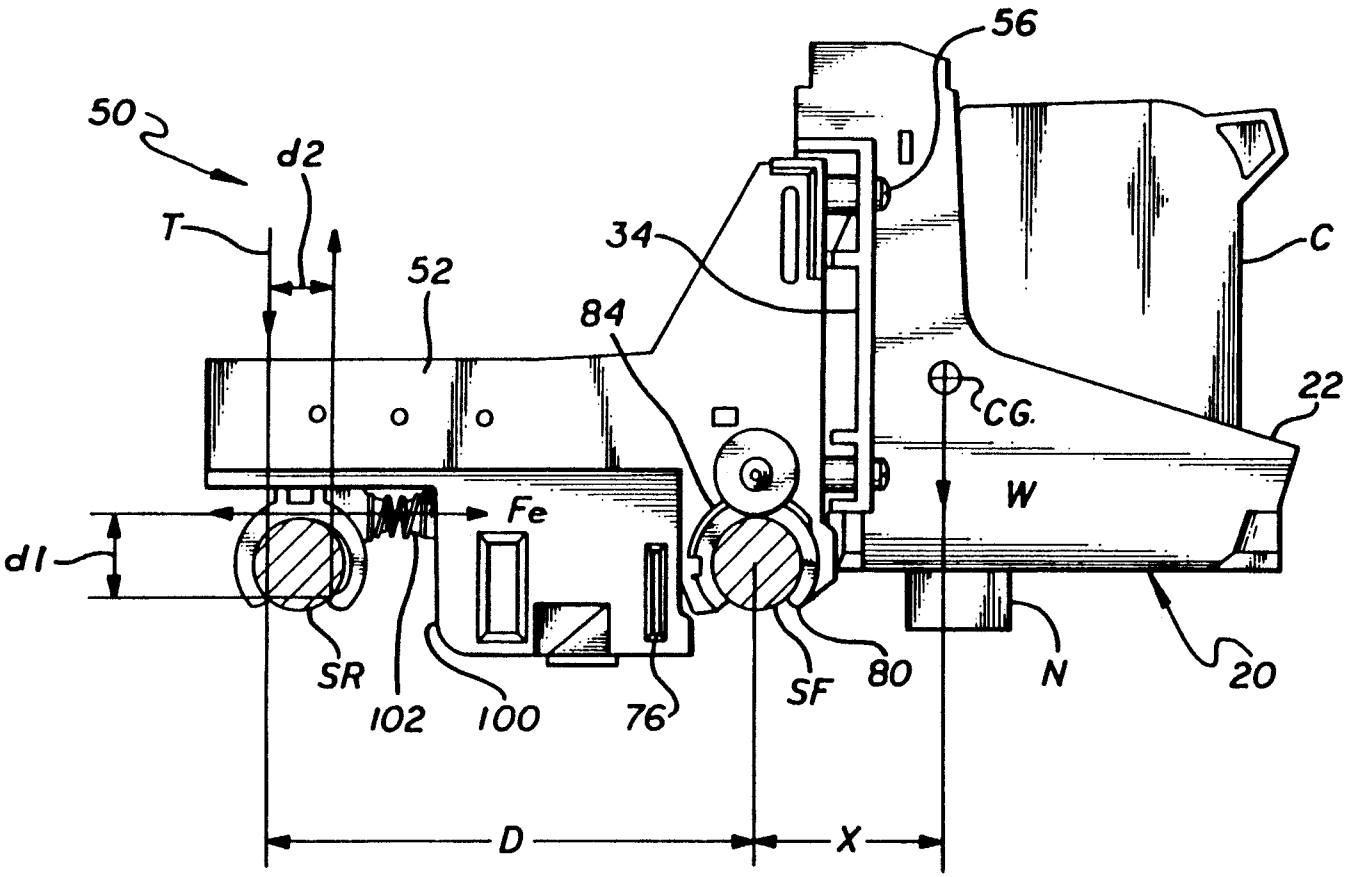
FIG. 2 is a side elevation of the carriage of FIG. 1.

The center of gravity CG of the carriage 10, when carrying four ink cartridges, is located slightly forward of the front slider rod. The location of the center of gravity and the vibration which occurs during printing tends to rotate the carriage frame around the front slider rod (clockwise as seen in FIG. 2) but is resisted by the contact force T acting on the carriage frame by the rear bushing lip 75 as a result of the spring bias. The spring seats 102, 104 are located such that the line of action of the spring 106 on the rear bushing 70 is off center thus creating a couple $F_p d_1$ on the rear bushing where $F_p$=preload force and $d_1$=the distance from the lower contact line L5 to the preload line of force of the spring 110. This couple is transferred by the bushing rear lip 75 to the carriage with a resulting opposed couple $Td_2$. The carriage is thus prevented from rotating while under functional vibrations until the vibrational load is greater than the couple $F_p d_1$. The carriage does not rotate as long as $TD > Wx$ where $T = F_p(d_1/d_2)$, $d_2$=the distance from the center of the rear slider rod to the line of action of force T, D=distance from the front slider rod center to the line of action of force T, W=the weight of the carriage acting through its center of gravity, and x=the distance from the front slider rod to the center of gravity.

In any plotter carriage it is essential that rotation of the carriage around the slider rods which has a drastically adverse effect on print quality be avoided or minimized. This objective ordinarily is accomplished by the use of expensive large carefully machined slider rods and bushings but is accomplished in the present carriage by a unique combination of features which results in lower overall cost. These features include, but are not necessary limited to, the following:

(1) The use of open C-shaped bushings which permit the use of smaller diameter slider rods due to the fact that the slider rods can be supported at locations intermediate their ends without interference with the sliding motion of the carriage;

(2) Positioning of the slider rods on opposite sides of the carriage drive belt;

(3) Positioning of the center of gravity of the carriage and print cartridges thereon in front of the front slider rod;

(4) The use of a rear bushing that is eccentrically spring biased away from the front bushings with a predeterminable and controllable degree of force which is low enough to permit free sliding motion yet high enough to reduce the amount of undesired rotation of the carriage around the front slider rod.

(5) The use of uniquely constructed bushings which each have two strategically located lines of contact with the associated slider rods.

Preferably, the bushings are all constructed of sintered bronze or a plastic material which is hard but lubricous. A preferred plastic combination is Nylon 6/6 mixed with about 13% Teflon and about 10% carbon fiber.

Persons skilled in the art will readily appreciate that various modifications can be made from the preferred embodiment thus the scope of protection is intended to be defined only by the limitations of the appended claims.

We claim:

1. A printer carriage comprising a frame having a plurality of print cartridge receptacles and a support system thereon, said support system comprising a front slider rod channel, a pair of bushings in said front slider rod channel for supporting said carriage for sliding movement on a front carriage slider rod, a rear slider rod bushing mounted on said carriage for supporting said carriage for sliding movement on a rear carriage slider rod, means for moveably mounting said rear bushing on said printer carriage to allow movement of said rear bushing relative to said front bushings, means for resiliently biasing said rear bushing in a direction away from said front bushings, said front and rear bushings each having first and second arcuately spaced contact surfaces for contacting the respective slider rods along two spaced parallel lines, said first contact surfaces on each bushing being proximate a top center portion thereof and said second contact surfaces of said front bushings substantially facing said second contact surface of said rear bushing.

2. The carriage of claim 1, wherein said front bushings are positioned at opposite ends of said front slider rod channel.

3. The carriage of claim 1, wherein said front bushings have a first common centerline and said rear bushing has a second centerline parallel to said first centerline, said first contact surfaces being located above said centerlines and said second contact surface of said rear bushing being located below said centerlines.

4. The carriage of claim 3, wherein said spring biases said rear bushing along a line eccentric to the axis of said rear bushing above said first and second centerlines.

5. The carriage of claim 4, further comprising a slot in said frame and a support wing and strut on said rear bushing, said rear bushing being supported on said frame by said wing which guides said rear bushing for longitudinal movement in said slot, and said spring comprising a compression spring seated between said frame and said rear bushing.

6. The carriage of claim 5, wherein said front and rear bushings are split bushings.

7. The carriage of claim 6, wherein said front and rear bushings are sintered bronze.

8. The carriage of claim 6, wherein said front and rear bushings are a mixture of nylon 6/6, polytetrafluorine plastic and carbon fiber.

9. The carriage of claim 1, wherein said frame is molded plastic.

* * * * *